United States Patent [19]

Mawby

[11] Patent Number: 4,844,244

[45] Date of Patent: Jul. 4, 1989

[54] CIGARETTE CASE WITH AUTO IGNITION

[75] Inventor: Richard J. Mawby, Landover Hills, Md.

[73] Assignee: Gary Mawby, Alexandria, Va.

[21] Appl. No.: 134,886

[22] Filed: Dec. 18, 1987

[51] Int. Cl.[4] ..... A24F 15/00

[52] U.S. Cl. ..... 206/88; 206/85; 206/89; 206/249

[58] Field of Search ..... 206/85, 87, 88, 89, 206/236, 249, 253, 256; 361/264

[56] References Cited

U.S. PATENT DOCUMENTS

| | | | |
|---|---|---|---|
| 1,164,782 | 12/1915 | Cohen | 206/256 |
| 1,174,872 | 3/1916 | Jolack | 206/256 |
| 1,290,663 | 1/1919 | Russell | 206/249 |
| 1,317,223 | 9/1919 | Russell | 206/249 |
| 1,704,844 | 3/1929 | Stewart . | |
| 1,729,108 | 9/1929 | Hammond, Jr. | 206/88 |
| 1,831,014 | 11/1931 | Leithelser | 206/88 |
| 1,956,187 | 4/1934 | Aronson | 206/87 |
| 2,002,846 | 5/1935 | Aronson | 206/87 |
| 2,030,011 | 2/1936 | MacLennan . | |
| 2,032,094 | 2/1936 | Voci | 206/88 |
| 2,033,108 | 3/1936 | Aronson | 206/87 |
| 2,073,962 | 3/1937 | Dion | 206/87 |
| 2,116,963 | 5/1938 | Aronson | 206/87 |
| 2,165,998 | 7/1939 | Silvestro | 206/88 |
| 2,207,593 | 7/1940 | Lorant | 206/88 |
| 2,232,334 | 2/1941 | Mellana | 206/88 |
| 2,419,458 | 4/1947 | Mayer . | |
| 2,528,619 | 11/1950 | Stein . | |
| 2,723,746 | 11/1955 | Stevenson et al. | 206/88 |
| 2,741,109 | 4/1956 | Dupuis | 206/87 |
| 2,856,098 | 10/1958 | Geisel | 206/88 |
| 4,000,812 | 1/1977 | Pisarski et al. | 206/87 |
| 4,507,704 | 3/1985 | Chuang . | |

FOREIGN PATENT DOCUMENTS

| | | | |
|---|---|---|---|
| 139143 | 3/1948 | Australia | 206/88 |
| 1218182 | 12/1954 | France . | |
| 503519 | 3/1960 | Italy . | |
| 235814 | 6/1925 | United Kingdom | 206/256 |

*Primary Examiner*—David T. Fidei

*Attorney, Agent, or Firm*—Saidman, Sterne, Kessler & Goldstein

[57] ABSTRACT

The cigarette case of the present invention is a convenient, hand-held cigarette case and lighter capable of performing several functions. The case can be used to store cigarettes in a safe and protective environment, it can eject either a lit or unlit cigarette from the case, and it is capable of being used as a standard lighter capable of igniting a cigarette or other object from a source external to the case itself.

24 Claims, 2 Drawing Sheets

CIGARETTE CASE WITH AUTO IGNITION

BACKGROUND OF THE INVENTION

The present invention relates to a portable cigarette case which can contain a plurality of cigarettes or small cigars.

Cigarette holders capable of automatically igniting a cigarette have long been known and used. Most of these devices have been large, bulky objects which would be difficult to carry in a purse or jacket pocket. Some of these previous devices are large table-top devices which must be plugged into an electrical outlet. Previous portable devices such as the one described in Chuang (U.S. Pat. No. 4,507,704) cannot contain and automatically ignite an entire pack of cigarettes (consisting of 20 cigarettes) without first reloading an internal chamber within the cigarette case. In addition, this device does not give the user the option to conveniently eject either a lit or an unlit cigarette from the case.

Thus, it is an object of the present invention to provide a device for conveniently carrying and automatically igniting a plurality of cigarettes.

SUMMARY OF THE INVENTION

The cigarette case of the present invention is a convenient, hand-held cigarette case and lighter capable of performing several functions. The case can be used to store cigarettes in a safe and protective environment, it can eject either a lit or unlit cigarette from the case, and it is capable of being used as a standard lighter capable of igniting a cigarette or other object from a source external to the case itself.

The case comprises a housing preferably made of a light material. Within the housing is a hollow compartment for storing and manipulating the cigarettes, and an ignition/engaging mechanism. Two manually operated levers can be used to control which of the above-mentioned functions the case will perform.

The hollow compartment preferably contains at least two retainer areas in which the cigarettes are secured. This advantageously enables the device to hold and manipulate a plurality of cigarettes (e.g. a standard pack of 20 cigarettes) without reloading the hollow compartment.

In operation, the cigarettes contained in a first retainer area are pushed toward the ignition/engaging mechanism by a first stack pushing mechanism. When all the cigarettes in this first retainer area are used up, a second retainer area containing additional cigarettes can position itself into the area previously occupied by the cigarettes of the first retainer area. In so doing, the cigarettes in the second retainer area will be in a position to be pushed into the ignition/engaging mechanism.

When a cigarette is in the ignition/engaging mechanism, it can be ejected from the housing i either a lit or unlit state. In a preferred embodiment, if an unlit cigarette is desired, a first switch is pulled back, causing an unlit cigarette to be ejected. If a lit cigarette is desired, the same first switch is pushed forward, causing the cigarette to enter a chamber containing a cigarette lighter. Pushing this first switch forward also causes the cigarette lighter to ignite, thus lighting the cigarette within the chamber. Once lit, the cigarette can be ejected by pulling the same switch back.

To use the device as a separate lighter without igniting a cigarette within the hollow compartment, a second switch is preferably provided on the same side of the housing as the first switch. When this switch is pushed forward, the cigarette lighter will ignite, allowing an external cigarette or other item to be lit.

BRIEF DESCRIPTION OF THE DRAWINGS

The present invention will be described with reference to the accompanying drawings, wherein.

DESCRIPTION OF THE PREFERRED EMBODIMENT

Figure 1:
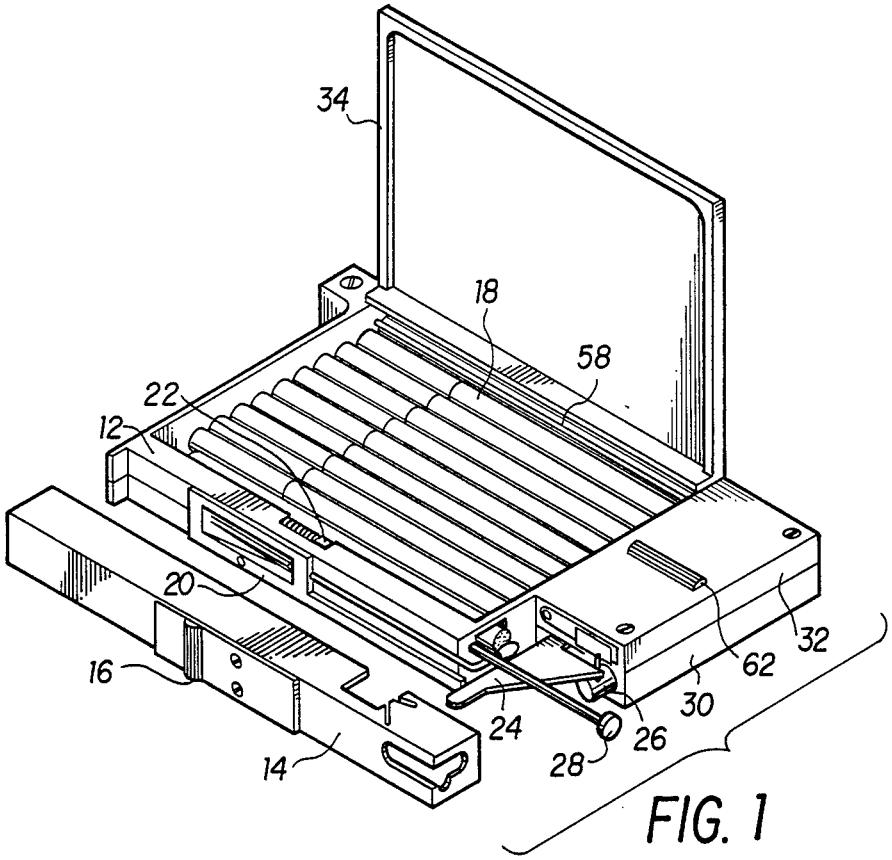
FIG. 1 shows an entire cigarette case with the access door open, exposing the hollow compartment containing cigarettes. Part of the housing is shown broken away to expose part of the ignition/engaging mechanism.

The present invention will be described with particular reference to the preferred embodiment shown in the drawings.

Referring to FIG. 1, a portable, hand-held cigarette case capable of holding and automatically lighting a plurality of cigarettes or small cigars (say, a standard pack of 20 cigarettes) comprises a housing 12 preferably made of a light metal such as aluminum. Within the housing 12 is a hollow chamber which is accessible through a feed chamber door 34. This door 34 preferably is connected to the housing 12 by a hinge (not shown) which allows the door 34 to swing open. The hinge is located along the area where the feed chamber door 34 and the housing 12 join, as shown by FIG. 1.

A feed chamber door release 62 is provided to secure the door 34 shut. This door release 62 is preferably a half-cylinder of metal or plastic. Protruding from the flat or cut-away portion of the half-cylinder are preferably two short, thin screws attached along the central axis of the half-cylinder. Attached at the other end of these screws is a thin, flat material preferably made of a light metal. This material is attached to the screws such that the flat side of this material is parallel to the flat portion of the cylinder. A slot is cut in a top housing 32 portion of the cigarette case beneath the half-cylinder portion of the door release 62 so that the thin screws can pass through the slot, thus causing the top housing 32 to come between the flat material and half-cylinder. This restricts the motion of the door release 6 to movement along the direction of the slot cut into the top housing 32. The end portion of the half-cylinder which faces the feed chamber door 34 has a small protrusion, which preferably is a small, thin piece of metal. The feed chamber door 34 has a groove cut into the side adjacent to the door release 62 into which the small protrusion can fit.

Figure 1A:
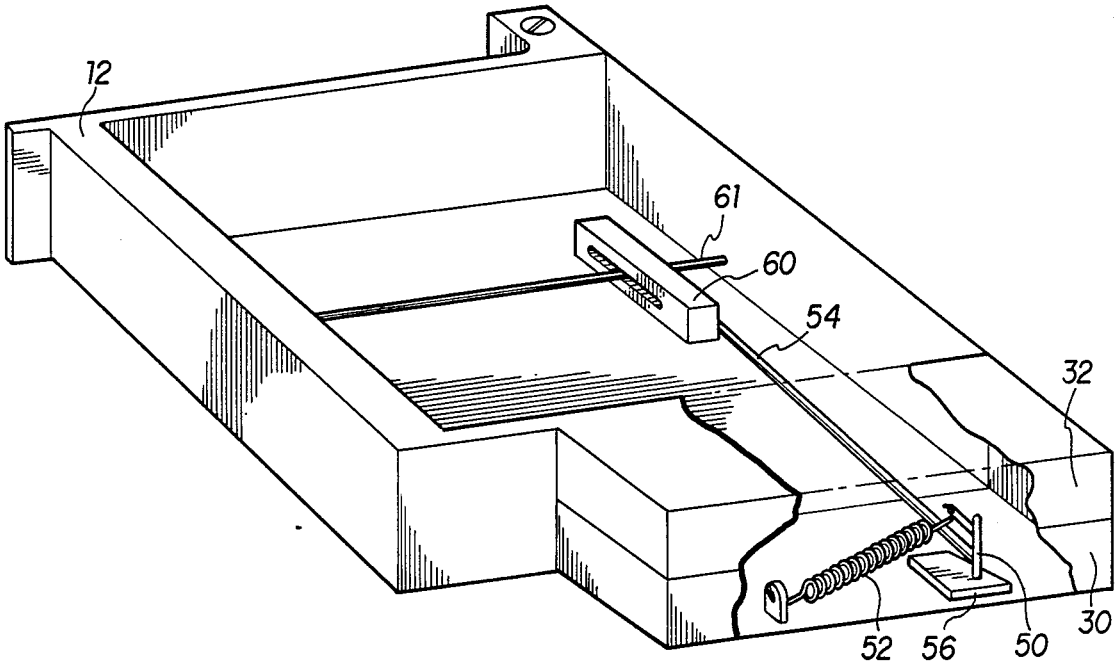
FIG. 1*a* shows a bottom stack cigarette-pushing mechanism.
Figure 1B:
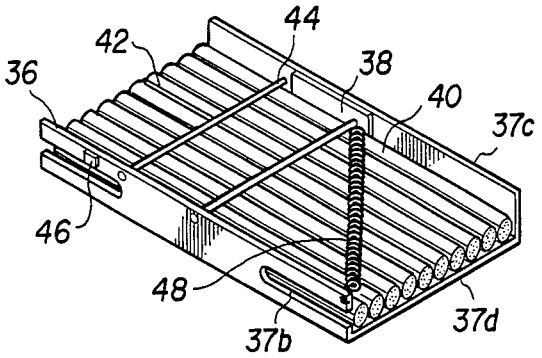
FIG. 1*b* shows a top stack retaining mechanism and pusher, which rests atop the bottom stack of cigarettes.

The hollow chamber within the housing 12 preferably contains a top stack retaining means which contains a top row of cigarettes as shown in FIG. 1*b*. Beneath this top stack retaining means lies a bottom row of cigarettes and part of a bottom stack pushing means as shown in FIG. 1*a*. While the preferred embodiment reveals a top and bottom row of cigarettes, a plurality of rows of cigarettes are possible.

The bottom stack pushing means shown in FIG. 1*a* comprises a bottom stack feed spring 52, a bottom stack pivot 50, a loading lever 56, a bottom stack push arm 54, and a bottom stack pusher 60. The bottom stack pushing means lies at the bottom of the hollow compartment which is encased by top and bottom housings 32 and 30 respectively, and is used to push the bottom row of cigarettes toward an ignition/engaging mechanism. A portion of the bottom stack pivot 5 protrudes from the underside of the bottom housing 30 95 depicted at FIG. 10, allowing the loading lever 56 to attach to the exposed end of the bottom stack pivot 50 so that the loading lever 56 itself is fully outside of the housing.

Attached to a portion of the bottom stack pivot 50 within the housings 30 and 32 is the bottom stack feed spring 52 and part of the bottom stack push arm 54. The bottom stack push arm 54 and loading lever 56 are rigidly attached to the bottom stack pivot 50, and are preferably attached so that they are parallel with one another. The bottom stack pivot 50 and bottom stack feed spring 52 are located within the top housing 32 portion of the cigarette case, which is generally part of the main housing 12. The bottom stack push arm 54 is preferably a thin, elongated piece of metal which can slide easily across the bottom of the hollow compartment and hollow chamber.

At the end of the bottom stack push arm 54 opposite to that end attached to the bottom stack pivot 50 is a small protrusion pointing upwards in the direction of the opening of the hollow compartment. This protrusion, preferably a small piece of metal, is used to attach the bottom stack push arm 54 to the bottom stack pusher 60. The bottom stack pusher 60 is preferably an elongated piece of plastic with a slit cut along its length and in the direction of the opening of the hollow compartment. The small protrusion on the bottom stack push arm 54 fits within this slot. The bottom stack pusher 60 should be oriented so that its long side is parallel with the orientation of the cigarettes 18. The bottom stack pusher also preferably has a small hole bored in a direction going across the width of the hollow compartment, and in a direction ninety degrees from that in which the cigarettes 18 rest. Through this hole is inserted a thin guide bar 61, which runs the width of the bottom of the hollow chamber, and is attached to the inside of the housing 12 at either end.

The top stack retainer means shown in FIG. 1*b* is preferably positioned within the hollow chamber of the housing 12 above the bottom stack retainer mean and bottom row of cigarettes shown in FIG. 1*a*. Thus when fully loaded, the top stack retainer means and cigarettes thereupon would be what would be viewed by a user who opened the feed chamber door 34 and exposed the hollow chamber. The top stack retaining means comprises a top stack retainer 36 upon which the top row of cigarettes rest. This top stack retainer 36 is preferably made of the same light metal as the housing 12, and has a bottom portion 37*a* and two side portions 37*b*, 37*c*. Stack pusher guide rods 44 are attached at either end to the two side portions 37*b* and 37*c*, and are at a height above the bottom portion 37*a* so that cigarettes will fit snugly beneath the guide rods 44. Attached to one of the guide rods 44 is a top stack pusher 38, which preferably is an elongated piece of plastic with a hole bored through it to allow a guide rod 44 to pass through. A feed spring 48 is attached at on end to a corner of the top stack retainer 36, and at the other end to the top stack pusher 38. Another guide rod has attached to it a top stack pressure release spring 42 which preferably consists of a thin strip of resilient metal which is bent upwards so that it protrudes from the hollow compartment when the feed chamber door 34 is open. A top stack retaining stop 46 is attached to a side portion of the top stack retainer 3 and preferably consists of a small piece of metal.

The mechanism which positions the top row of cigarettes for consumption consists of a top stack retainer knob and shaft 28 which has a top stack retainer stopper 22 connected at one end. A hole is bored through the housing 12 so that the shaft 28 can pass through and connect with the top stack retainer stopper 22. It is upon this top stack retainer stopper 22 that the top stack retaining stop 46 rests. Preferably, the portion of the shaft 28 connected to the stopper 22 is partially carved out, so that when the knob at the opposite end of the shaft 28 is pushed, a mostly empty space is left where the stopper 22 had previously been. A spring pushes against the stopper 22 on the side opposite to that where the shaft 28 is attached, so that releasing the knob and shaft 28 will cause the stopper 22 to reset itself at its previous position.

Figure 1C:
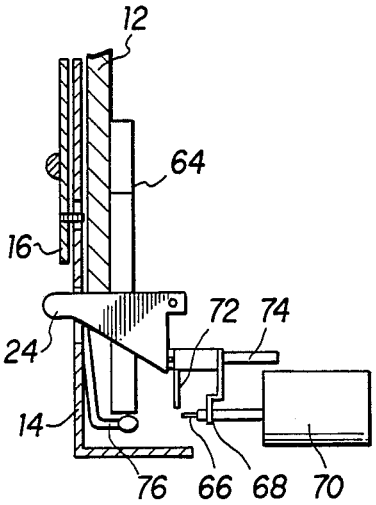
FIG. 1*c* shows an ignition mechanism for lighting a cigarette or other object.

A cigarette is manipulated and ignited by the mechanism shown in FIG. 1*c*. This mechanism lies beneath case cover 14 and the top housing 32, and can be envisioned with respect to FIG. 1 by noting that the gas tank 70 shown in FIG. 1*c* lies within the top housing 32, and by noting the respective positions of a cigarette actuator 16 and piezo impact lever 24 in both of these figures. The cigarette 64 represents a cigarette within the hollow compartment, adjacent to an ejection bar 76.

Referring to FIG. 1*c*, the cigarette actuator 16 is attached through a slit in the case cover 14 and housing 12 to the ejection bar 76 located within the hollow compartment. In a preferred embodiment, the cigarette actuator 16 is slidable such that sliding the cigarette actuator 16 in a given direction will cause the ejection bar 76 to also slide in that direction. Preferably, the ejection bar 76 is an elongated piece of heat-resistent metal which is bent ninety degrees at either end (FIG. 1*c* only shows one end). The length of the ejection bar 76 between the bent points should be somewhat longer than the length of the cigar or cigarette to be used. There is preferably an ejection opening (not shown) in the housing 12 at the end opposite the ignition mechanism where the cigarettes can be ejected from the housing 12.

FIG. 1*c* also reveals the ignition mechanism which preferably uses butane as a means for igniting the cigarettes, but which can also use other flammable liquids or gasses, or which can use an electrical ignition system. The ignition mechanism is preferably housed within the top housing 32. A piezo impact lever 24 is preferably used as a trigger to ignite the flammable gas. The piezo impact lever 24 is preferably a flat piece of metal shaped so that a portion of it protrudes from the housing 12, and is attached to the housing 12 so that it can rotate and bend a piezoelectric crystal. End 21 of ejection bar mover 20 can be pushed up against this lever 24, causing it to rotate. The ignition mechanism also comprises an electrode 72, a piezoelectric charge generator 74, a gas valve 66, a gas valve actuator 68, and a gas tank 70.

In operation, the bottom row of cigarettes are loaded into the bottom of the hollow chamber by rotating the loading lever 56 so that the bottom stack pusher 60 is on the opposite side of the hollow compartment from the ejection bar 76. The cigarettes are then placed along the bottom of the hollow compartment such that the front ends of the cigarettes are facing the ignition mechanism within the top housing 32. The loading lever 56 is then carefully released. To load the top row of cigarettes, the top stack pusher 38 must be forced back along the guide rod 44, and the cigarettes placed between the guide rods 44 and the bottom portion of the top stack retainer 36. The top stack pusher 38 is then carefully released. The top stack retainer 36 is placed into the hollow compartment atop the bottom row of cigarettes such that the top stack retaining stop 46 rests upon the top stack retainer stopper 22. When positioned accordingly, the cigarettes in the top stack retainer 36 should be facing the general direction of the ignition mechanism.

Preferably, the feed chamber door 34 can be locked by swinging the door 34 into a closed position, and sliding the feed chamber door release 62 toward the door 34 such that the small protrusion from the door release 62 is inserted into the groove on the side of the door 34. This prevents the door 34 from opening unless the door release 62 is slid in a direction away from the door 34. When it is desired that the door 34 be opened, the release 62 can be slid in a direction away from the door 34, and the top stack pressure release spring 42 will cause the door 34 to pop open.

In a preferred embodiment, the bottom row of cigarettes are first consumed, after which the top row can be manipulated so that it, too, can be consumed. In order to be manipulated and consumed, a cigarette must be on the bottom level in line with the ignition mechanism. To begin using the top row of cigarettes once the bottom row has been used, the top stack retainer knob and shaft 28 is pushed, causing the top stack retainer stopper 22 to move forward. This places the carved out portion of the shaft 28 in the place where the stopper 22 had been. The top stack retaining stop 46, which had held up the top stack retainer 36, falls through the opening, and causes the top stack retainer 36 to pivotally fall into the bottom portion of the hollow compartment. While the shaft 28 is being pushed, the loading lever 56 is then rotated so that the bottom stack pusher 60 is moved to the side of the hollow compartment opposite to where the top stack retainer 36 collapsed into the bottom portion of the hollow compartment. The retainer knob and shaft 28 is released before the loading lever 56 s that the top stack retaining stop 46 is caught beneath the top stack retainer stopper 22 when the shaft 28 is released. This holds the top stack retainer 36 in the partially collapsed position.

When a cigarette is pushed adjacent to the ejection bar 76 by either the top stack pusher 38 or bottom stack pusher 60, it is in a position to be ejected from the housing 12 in either a lit or unlit state. Ejection of an unlit cigarette can be accomplished by engaging the cigarette actuator 16 in a direction toward the ejection opening in the housing 12. This will cause the ejection bar 76 to move toward the opening in the housing 12. The bent front portion of the ejection bar 76 will push against the front of the cigarette 64, and force a cigarette 64 out of the ejection opening in the housing 12. The cigarette will emerge from the housing filter first, and can then be taken by the user.

If it is desired to light and eject a cigarette from the hollow compartment, then the cigarette actuator 16 can be pushed in a direction opposite from that direction for ejecting an unlit cigarette, and toward the ignition mechanism. The bent rear portion (not shown) of the ejection bar 76 will push upon the filter of a cigarette 64, and move the cigarette 64 toward the gas valve 66. This will position the front end of the cigarette 64 so that it is adjacent to the gas valve 66. Moving the cigarette actuator 16 in this direction will also cause the ejection bar 76 to rotate the piezo-electric impact lever 24. Rotation of this lever 24 will cause the gas valve actuator 68 to release flammable gas, preferably butane, from the gas tank 70 and through the gas valve 66. Rotation of this lever 24 will also cause the piezo-electric charge generator 74 to activate the electrode 72. This simultaneous activation of the gas valve actuator 68 and electrode 72 results in the ignition of the flammable gas from the gas valve 66, and will subsequently result in the ignition of the front end of a cigarette 64 adjacent to the gas valve 66. To eject the lit cigarette from the housing 12, the cigarette actuator 16 is pulled back in the same manner as described above for ejecting an unlit cigarette. Again, the thumb actuator 16 will cause the ejection bar 76 to push the front end of a cigarette 64 such that the cigarette 64 will be ejected from the housing 12 filter first.

The ignition mechanism of this invention can also be activated without igniting a cigarette from the hollow compartment. This enables a cigarette or other object external to the housing 12 to be lit by the cigarette case. As shown in FIG. 1*c*, a portion of the piezo-electric impact lever 24 protrudes from the housing 12, enabling a user to rotate the lever 24 directly, without the use of the cigarette actuator 16. This will cause the flammable gas to ignite as described above, but will not cause the ejection bar 76 to move. Thus, a cigarette from the hollow chamber will be neither lit nor ejected. An opening in the housing 12 allows the flame from the gas valve 66 to emerge from the interior of the housing 12.

As will be recognized by those skilled in the art, the innovative concepts described in the present application can be modified and varied over a substantial range of applications, and accordingly their scope is not limited except by the allowed claims.

What I claim is:

1. A cigarette case comprising:

a housing having a hollow compartment for containing a plurality of cigarettes;

ignition means for igniting a cigarette;

engaging means for receiving a single cigarette from said hollow compartment and movably engaging the cigarette from said hollow compartment toward said ignition means when said engaging means is moved in a first direction, and for ejecting said cigarette from said housing when said engaging means is moved in a second direction; and trigger means coupled with said engaging means and said ignition means for operating said ignition means when said engaging means is moved in said first direction.

2. A cigarette case in accordance with claim 1, wherein engaging means can be moved initially in said second direction for the ejection of an unlit cigarette from said housing.

3. A cigarette case in accordance with claim 1, wherein said trigger means is operable independently of said engaging means so that ignition means can be activated to light a cigarette outside of said housing.

4. A cigarette case with trigger means in accordance with claim 3, wherein said trigger means comprises a piezoelectric impact lever for operation of said ignition means without activating said engaging means and without igniting a cigarette from said hollow compartment.

5. A cigarette case in accordance with claim 1, further comprising a stack pushing means for pushing said plurality of cigarettes toward said engaging means.

6. A cigarette case with stack pushing means in accordance with claim 5, wherein said pushing means comprises a stack pusher, a stack push arm, and a stack feed spring; said stack pusher is coupled to said stack push arm, said stack push arm is in turn coupled to said stack feed spring, causing said stack pusher to be forced in a direction toward said engaging means.

7. A cigarette case in accordance with claim 1, further comprising a top stack retaining means for containing a top row of cigarettes which resides above a bottom row of cigarettes in said hollow compartment.

8. A cigarette case with top stack retaining means in accordance with claim 7, wherein said top stack retaining means comprises a top stack retainer upon which said top stack of cigarettes rests, a top stack pusher for pushing said top row of cigarette toward said engaging means, a top stack feed spring for pulling top stack pusher, and at least one guide bar spanning the width of said top stack retainer for guiding said top stack pusher.

9. A cigarette case with top stack retaining means in accordance with claim 7, wherein said top stack retaining means pivotally collapses into a bottom portion of said hollow compartment when said bottom row of cigarettes beneath said top stack retainer are spent.

10. A cigarette case with a pivotally collapsing top stack retainer in accordance with claim 9, further comprising a top stack retainer knob and a top stack retainer stopper; said top stack retainer knob is coupled with said top stack retainer stopper so that when said top stack retainer knob is moved in a specified direction, said top stack retainer stopper is displaced, and said top stack retaining means pivotally collapses into a bottom portion of said hollow compartment.

11. A cigarette case in accordance with claim 1, wherein said hollow compartment includes accessibility means which can be opened or removed to access said hollow compartment.

12. A cigarette case with accessibility means in accordance with claim 11, wherein said accessibility means comprises a one-piece door with hinges on one side, a release mechanism, and a pressure release spring; said one-piece door is unlocked when said release mechanism is moved in a specified direction, and said pressure release spring forces unlocked said one-piece door into an open position.

13. A cigarette case with engaging means in accordance with claim 1, wherein said engaging means comprises a thumb actuation means which is attached to the outside of said housing, and an elongated member capable of movement along one side of said hollow compartment in a first direction toward said ignition means, and in a second direction away from said ignition means; said thumb actuation means coupled to said elongated member for operation of said elongated member by moving said thumb actuation means in said first and second directions; said elongated member is connected at one end to an ignition bar for pushing a cigarette within said hollow compartment into said ignition chamber when elongated member moves in said first direction, and said elongated member is connected at its other end to an ejection bar for pushing a cigarette out of said housing when elongated member is moved in said second direction.

14. A cigarette case in accordance with claim 1, wherein said trigger means comprises a piezo-electric impact lever; said piezo-electric impact lever is coupled with said engaging means and said ignition means; said piezo-electric impact lever is caused to rotate when said engaging means is moved in a first direction, said rotation then causing activation of said ignition means.

15. A cigarette case in accordance with claim 1, wherein said ignition means comprises fuel means and fuel ignition means; said fuel means is caused to open upon activation of said trigger means, and said fuel ignition means is also activated upon activation of said trigger means.

16. A cigarette case with fuel means and fuel ignition means in accordance with claim 15, wherein said fuel means comprises a refillable butane tank, and fuel ignition means comprises a spark generating piezo-electric crystal.

17. A cigarette case comprising:

a housing having a hollow compartment containing plurality of cigarettes;

ignition means for igniting a cigarette;

engaging means for movably engaging a cigarette from said housing into said ignition chamber when said engaging means is moved in a first direction, and for ejecting said cigarette from said housing when said engaging means is moved in a second direction;

said engaging means also initially movable in said second direction for the ejection of an unlit cigarette from said housing;

trigger means coupled with said engaging means and said ignition means for operating said ignition means when said engaging means is moved in said first direction; and said trigger means also operable independently of said engaging means so that said ignition means can be used to light a cigarette outside of said housing.

18. A cigarette case in accordance with claim 17, wherein said hollow compartment comprises a bottom stack pushing means for pushing a bottom row of cigarettes toward said engaging means; a top stack retaining means including a top stack pushing means for pushing a top row of cigarettes toward said engaging means; said top stack retaining means pivotally collapses into a bottom portion of said hollow compartment when said bottom row of cigarettes are spent; said hollow compartment comprises accessibility means which can be opened or removed to attain access to said hollow compartment.

19. A cigarette case in accordance with claim 18, wherein said bottom stack pushing means comprises a thumb-corking lever, a bottom stack pusher, a bottom stack push arm, and a bottom stack feed spring; said bottom stack pusher is coupled to said thumb-corking lever by said bottom stack push arm, said stack push arm is coupled to said bottom stack feed spring which results in bottom stack pusher being forced toward said engaging means.

20. A cigarette case in accordance with claim 18, wherein said top stack retaining means comprises a top stack retainer upon which said top stack of cigarettes rest, a top stack pushing means comprising a top stack pusher for pushing said top row of cigarettes toward said engaging means, a top stack feed spring for pulling said top stack pusher, and at least one guide bar spanning the width of said top stack retainer for guiding said top stack pusher.

21. A cigarette case in accordance with claim 18, further comprising a top stack retainer knob and a top stack retainer stopper; said top stack retainer knob is coupled with said top stack retainer stopper so that when top stack retainer knob is moved in a specified direction, said top stack retainer stopper is displaced, and said top stack retaining means pivotally collapses into a bottom portion of said hollow compartment.

22. A cigarette case in accordance with claim 17, wherein said engaging means comprises a thumb actuation means which is attached to the outside f said housing, and an elongated member capable of movement along one side of said hollow compartment in a first direction toward said ignition means, and in a second direction away from said ignition means; said thumb actuation means coupled to said elongated member for operation of said elongated member by moving said thumb actuation means in said first and second directions; said elongated member is connected at one end to an ignition bar for pushing a cigarette within said hollow compartment into said ignition chamber when elongated member moves in said first direction, and said elongated member is connected at its other end to an ejection bar for pushing a cigarette out of said housing when elongated member is moved in said second direction.

23. A cigarette case in accordance with claim 17, wherein said trigger means comprises a piezo-electric impact lever coupled with said engaging means and said ignition means; said piezo-electric impact lever is caused to rotate when said engaging means is moved in a first direction, said rotation then causing activation of said ignition means.

24. A cigarette case in accordance with claim 17, wherein said ignition means comprises fuel means and fuel ignition means; said fuel means is caused to open upon activation of said trigger means, and said fuel ignition means is also activated upon activation of said trigger means.

* * * * *